US009580269B2

(12) United States Patent
Quarandillo-Wold

(10) Patent No.: US 9,580,269 B2
(45) Date of Patent: Feb. 28, 2017

(54) YARN PROTECTING DISPENSER

(71) Applicant: Julie Ann Quarandillo-Wold, Elkhart, IN (US)

(72) Inventor: Julie Ann Quarandillo-Wold, Elkhart, IN (US)

( * ) Notice: Subject to any disclaimer, the term of this patent is extended or adjusted under 35 U.S.C. 154(b) by 142 days.

(21) Appl. No.: 14/609,541

(22) Filed: Jan. 30, 2015

(65) Prior Publication Data

US 2015/0239706 A1 Aug. 27, 2015

Related U.S. Application Data

(60) Provisional application No. 61/936,391, filed on Feb. 6, 2014.

(51) Int. Cl.

| | |
|---|---|
| ***B65H 49/08*** | (2006.01) |
| ***D04B 3/06*** | (2006.01) |
| ***D04B 33/00*** | (2006.01) |

(52) U.S. Cl.

CPC ..... *B65H 49/08* (2013.01); *D04B 3/06* (2013.01); *D04B 33/00* (2013.01); *B65H 2701/31* (2013.01)

(58) Field of Classification Search

CPC ..... B65H 49/08; B65H 49/205; B65H 49/30; B65H 75/16; D04B 3/06; D04B 33/00

See application file for complete search history.

(56) References Cited

U.S. PATENT DOCUMENTS 1,240,045 A * 9/1917 Hammond-Knowlton ..... B65H 49/08 242/137.1

5,544,831 A * 8/1996 Van Netta ..... D05B 91/16 206/388

FOREIGN PATENT DOCUMENTS

| | | | | |
|---|---|---|---|---|
| DE | 3414574 A1 * | 10/1985 | ..... | B65H 49/205 |
| GB | 874715 A * | 8/1961 | ..... | B65D 11/188 |
| GB | 908396 A * | 10/1962 | ..... | D04B 3/06 |

OTHER PUBLICATIONS

Machine Translation of DE 3414574 A1, Oct. 24, 1985.*

* cited by examiner

*Primary Examiner* — William E Dondero

(57) ABSTRACT

An apparatus for holding, protecting and dispensing yarn from a skein of yarn. This device includes a hollow tube with elongated jointed sides for opening and closing. The tube is secured by way of an open/close mechanism. When closed, one ends of the hollow tube comprising; of indentured halves form an exit point for a strand(s) of yarn. One end of the hollow tube halves when closed forms a whole surface area, allowing support for the skein of yarn to rest upon when in the upright position.

5 Claims, 3 Drawing Sheets

YARN PROTECTING DISPENSER

CROSS-REFERENCES TO RELATED APPLICATIONS

This patent application claims the benefit of U.S. Provisional Application No. 61/936,391, filed Feb. 6, 2014, entitled "Yarn Protecting Dispenser" in the name of the same inventor, and which is incorporated herein by reference in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention relates generally to the storage and protection of yarn and more particularly to a device for accessing, holding, protecting and dispensing of yarn from skein form for knitting and crocheting.

The art of knitting and crocheting has been around for centuries, growing in popularity, becoming a worldwide hobby industry. Today, not only women and girls, but men and boys indulge in this form of artistry, creating items of necessity, desire and beauty.

The yarn or other fiber used in knitting and crocheting is generally obtained by the consumer in skein form. The crafter then has the choice of knitting or crocheting directly from the skein which often results in non-productive time removing irritating tangles or debris that can attach to the yarn as it is being worked and having to rewind the skein into a more usable form. More complex yarn texture choices can increase tangling problems as well as potential to damage the entire skein with unwanted debris from working or crafting area.

These problems are not rare and have frustrated crafters over long periods of time. Many attempts to correct some of the issues have been made. All of these existing products have specific drawbacks. Some of the devices are extremely archaic and no longer apply to current standards of use, or are not ascetically decorative. Others simply result in exchanging an old problem for a new one. The biggest drawback is lack of quality protection of the yarn, while allowing complete access to the entire skein without disrupting the in-progress craft.

Poor attempts trap the skein inside, and once the project begins, the crafter must amputate the "working" yarn from the current project. This can be a defeating frustration to a crafter when a specific pattern and directions call for switching of the yarn in the middle of a project. Other devices do not completely cover the yarn, leaving it susceptible to dirt and debris.

Therefore, a need existed to provide a device and method to overcome the above problems.

SUMMARY OF THE INVENTION

An advantage of the device described herein is that it conquers disadvantages of the prior art. This and other advantages are provided by a yarn protecting and dispensing apparatus comprising; a hollow tube having a joint along one elongated side that allows the apparatus to open and close, exposing a protective area to lay a skein(s) of yarn inside. One elongated side to have an open/closure mechanism, providing access to entire skein at any stage of working project. One end of hollow tube comprising two halves, that when elongated sides are closed, create a whole surface area providing protection to the entire skein of yarn. At least one end of hollow tube comprising two indentured halves, that when elongated sides of tube are closed together, halves form an exit point for dispensing strand(s) of yarn from skein.

BRIEF DESCRIPTION OF THE SEVERAL VIEWS OF THE DRAWINGS

Other objects and advantages of the invention will become apparent upon reading the following detailed description and upon reference to the drawings in which like numerals refer to like elements, and where in.

DETAILED DESCRIPTION OF THE INVENTION

Described herein are embodiments of a yarn protecting and dispensing apparatus. The embodiments described allow knitters and crocheters to protect, carry and dispense skeins of yarn for crafting. The embodiments prevent the skein of yarn from rolling away or getting tangled or intertwined. The embodiments smoothly dispense the yarn, while protecting the skein from coming in contact with dirt and debris. Complete access to the entire skein of yarn is provided by opening the jointed hollow tube using an open/close mechanism.

Figure 1:
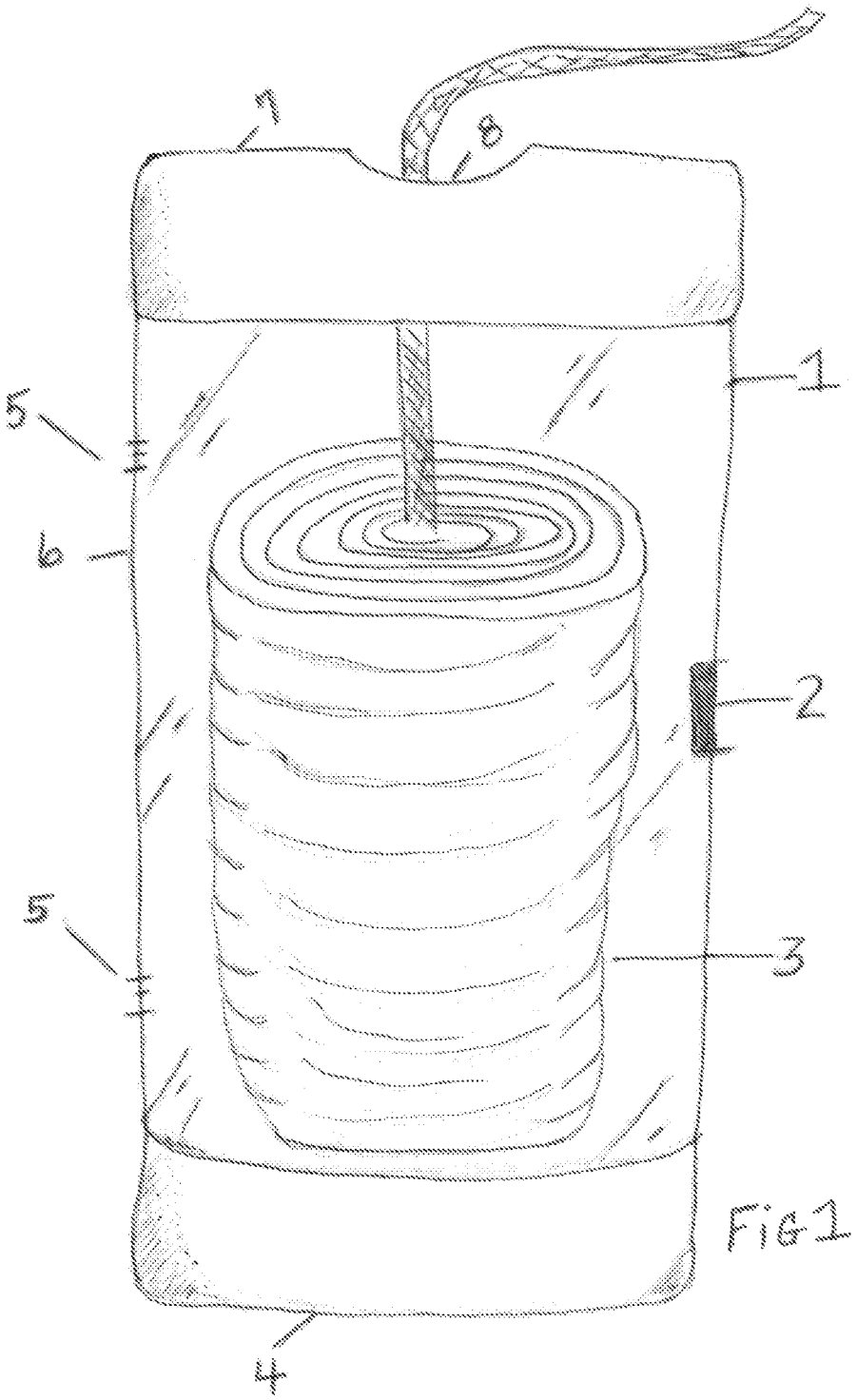
FIG. 1 is a perspective view of a preferred embodiment of the yarn protecting dispenser shown with contained skein of yarn for illustration purposes.

Referencing to FIG. 1; a method of use of the present invention is illustrated. The hollow tube consists of two elongated sides 1 and 6 with jointing 5 on elongated sides 6 and an open/close mechanism 2 on the opposite elongated side 1. The said jointing 5 can be a pivotal jointing connection or hinge. The indentured end sections or halves 4 when joined form a whole area which allows the skein of yarn 3 a surface to sit upon when dispenser is in an upright position.

Figure 2:
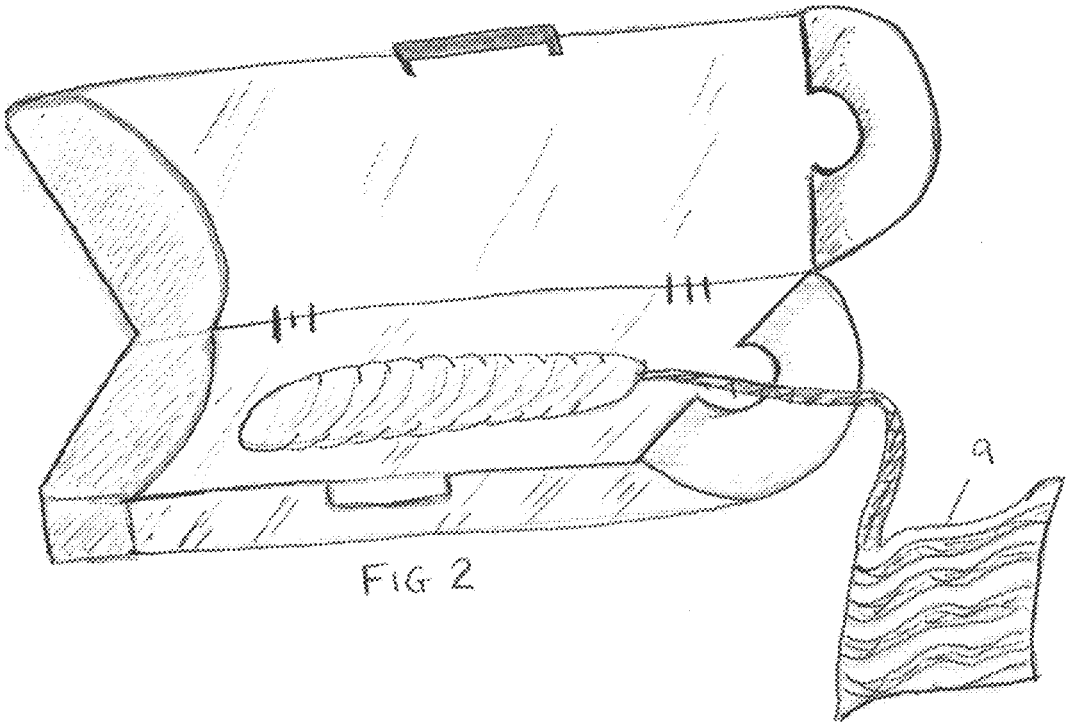
FIG. 2 is a perspective view of a preferred embodiment of the yarn protecting dispenser in a laid-open condition containing a skein of yarn and in-progress craft for illustration purposes.

Turning now to FIG. 2; a yarn protecting dispenser, in its laid-open condition with skein of yarn and a craft project 9 in progress for illustration purposes. When open providing complete access to whole skein and current working yarn attached to project 9. Allowing user to lift entire skein and project out as one unit and not requiring the severing of either end of yarn or craft project.

Figure 3:
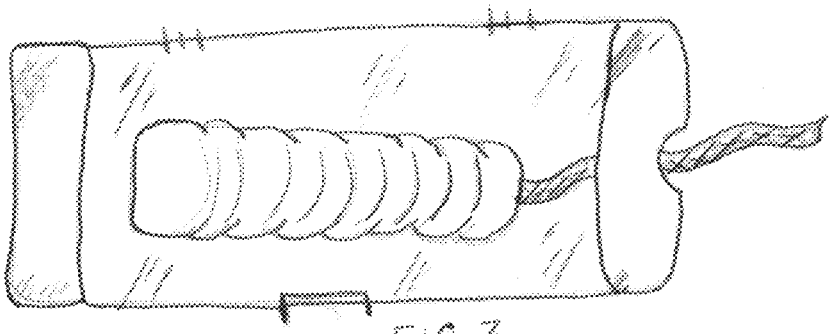
FIG. 3 is a perspective view of a preferred embodiment of the present invention in a laid-closed condition containing a skein of yarn for illustration purposes.

FIG. 3; illustrates another embodiment of a yarn protecting dispenser in its laid-closed condition, with a skein of yarn ter illustration purposes. The dispenser in this condition is ready for use by artisan and yarn is protected from the elements, tangling or accumulating of unwanted debris.

Figure 4:
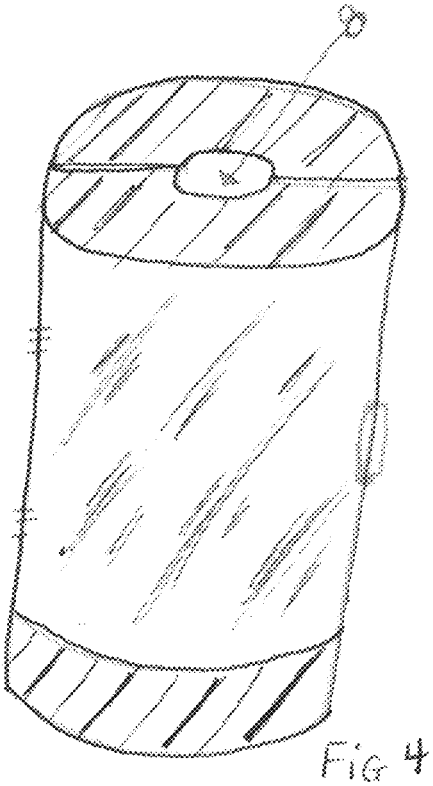
FIG. 4 is a perspective view of the top of invention indicating point of exit for a strand(s) of yarn in an upright condition.
Figure 5:
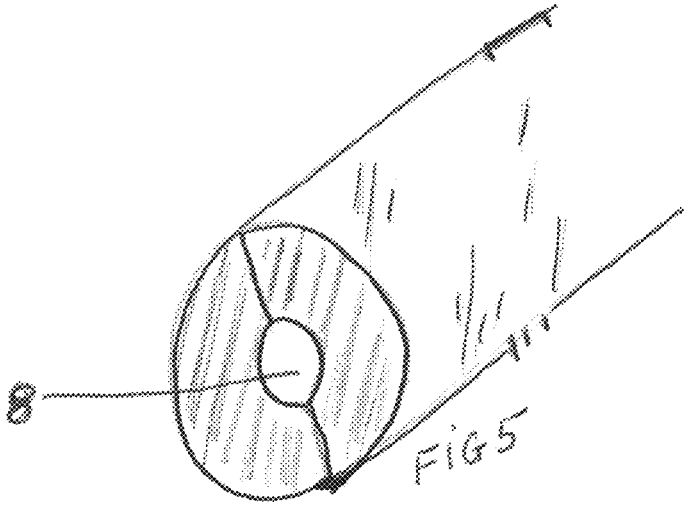
FIG. 5 is a perspective view of the top of invention indicating point of exit for a strand(s) of yarn in a laid-closed condition.

Looking now at FIGS. 4 and 5; the view of the top of the device where the two indentured end halves are joined forming an exit point 8 for a strand(s) of yarn. Indicating apparatus can be used in an upright position or a laid down position next to artisan.

The yarn protecting dispensing apparatus may be used to contain yarn, thread, string or other similar material. The yarn protecting and dispensing apparatus may be used while knitting, crocheting, or doing other work that involves loose and/or organized skeins and/or balls of material or fiber. The yarn protecting dispensing apparatus holds the material secure while also allowing for complete access to the skein during the creation of a project. The yarn protecting dispenser apparatus provides a knitter or crocheter the freedom to take their project with them while traveling, offering the yarn protection and dispensed clean, tangle free, and easily accessed or changed as needed.

The dimensions and/or size of holder (FIG. 1) and its features should not be limited to those above. The features of the holder parts or mechanisms including, but not limited to diameter, length, width or thickness, should not be limited based on illustrations. Markings and proportions were shown for understanding and clarity purposes only.

The type(s) of materials and/or methods used to manufacture holder (FIG. 1), should not be limited. As an example, yarn protecting dispenser may be made out of formed or molded plastic.

The terms and descriptions used herein are set forth by way of illustration only and are not meant as limitations. Those skilled in the art will recognize that many variations are possible within the spirit and scope of the invention.

Thus, it is apparent that there has been provided, in accordance with the invention, a yarn holder, protector and dispenser that fully satisfy the objects, aims and advantages set forth above.

The invention claimed is:

1. A yarn protecting and dispensing device comprised of an elongated hollow body; said body being comprised of complimentary sides and respective associated end sections with pivotal jointing connection means between said sides on one edge thereof allowing said sides and associated said end sections to open and close from each other; an open/close mechanism on the edge opposite from said pivotal jointing connection means; with at least one of the complimentary said end sections providing an opening for yarn exit when said sides are in a closed position.

2. A yarn protecting and dispensing device according to claim 1 with plural pivotal jointing connections between said sides.

3. A yarn protecting and dispensing device according to claim 1 with the other said complimentary end sections forming a whole surface area when said elongated sides are closed together.

4. A yarn protecting and dispensing device according to claim 1 wherein said complimentary sides are halves of a tube section.

5. A yarn protecting and dispensing device according to claim 1 wherein said complimentary sides are molded halves.

* * * * *